US005779045A

United States Patent [19]

Yu

[11] Patent Number: 5,779,045

[45] Date of Patent: Jul. 14, 1998

[54] CEILING FAN PACKAGE

[76] Inventor: Jack Yu, No. 109-1, Avenue 6, Lane 164, Tzong Sa Road, Da Du Hsiang, Taichung Hsien, Taiwan

[21] Appl. No.: 844,509

[22] Filed: Apr. 18, 1997

[51] Int. Cl.[6] ..... B65D 85/00

[52] U.S. Cl. ..... 206/320; 206/523

[58] Field of Search ..... 206/320, 523, 206/576, 590

[56] References Cited

U.S. PATENT DOCUMENTS 3,414,121 12/1968 Suzuki ..... 206/320
4,828,115 5/1989 Wiegand et al. ..... 206/576
5,366,080 11/1994 Carstersen et al. ..... 206/523
5,405,012 4/1995 Shindler et al. ..... 206/523

*Primary Examiner*—David T. Fidei
*Attorney, Agent, or Firm*—Charles E. Baxley, Esq.

[57] ABSTRACT

A package for a ceiling fan includes a lower casing and an upper casing each having an opening engaging with the ceiling fan housing. The casings includes three or more bars and lumps and ribs for engaging with the upper and the lower and the outer peripheral surfaces of the ceiling fan housing. The upper housing includes a space for engaging with the control box and includes a cylindrical wall for engaging with the motor and for stably retaining the motor in place. The casings include a number of slits and punctures for forming a shock absorbing structure.

6 Claims, 4 Drawing Sheets

CEILING FAN PACKAGE

BACKGROUND OF THE INVENTION

1. Field of the Invention

The present invention relates to a package, and more particularly to a ceiling fan package.

2. Description of the Prior Art

Typical ceiling fan package devices comprise a lower casing and an upper casing for engaging the ceiling fan between the casings. However, the ceiling fan is normally loosely received in the casings and may not be stably retained place. In addition, no cushioning configuration is provided for absorbing shocks and vibrations that may be transmitted to the ceiling fan.

The present invention has arisen to mitigate and/or obviate the afore-described disadvantages of the conventional ceiling fan packages.

SUMMARY OF THE INVENTION

The primary objective of the present invention is to provide a ceiling fan package which may stably retain the ceiling fan in place and which may absorb shocks that may be transmitted to the ceiling fan.

In accordance with one aspect of the invention, there is provided a package for receiving a ceiling having a housing and a motor disposed in the housing and a control box coupled to the motor, the housing including an upper surface and a lower surface and a peripheral surface and a shaft extended from the upper surface, the package comprises a lower casing including bore for receiving the shaft, and including a first opening for engaging with the housing, and including at least three bars for engaging with the upper surface of the housing, and including at least three first ribs radially extended inward of the first opening for engaging with the outer peripheral surface of the housing, and an upper casing including a second opening for engaging with the housing, and including a space for engaging with the control box, and including at least three lumps for engaging with the lower surface of the housing and for stably retaining the housing in the package.

The upper casing further includes a cylindrical wall for defining the space and for engaging with the motor and for stably retaining the motor in place.

The cylindrical wall includes at least one slit for forming a shock absorbing configuration.

The upper casing includes at least three second ribs radially extended inward of the second opening for engaging with the outer peripheral surface of the housing.

The upper casing includes at least one puncture for forming a shock absorbing configuration.

The upper casing and the lower casing each includes an outer peripheral surface having a plurality of swellings for forming a shock absorbing configuration.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
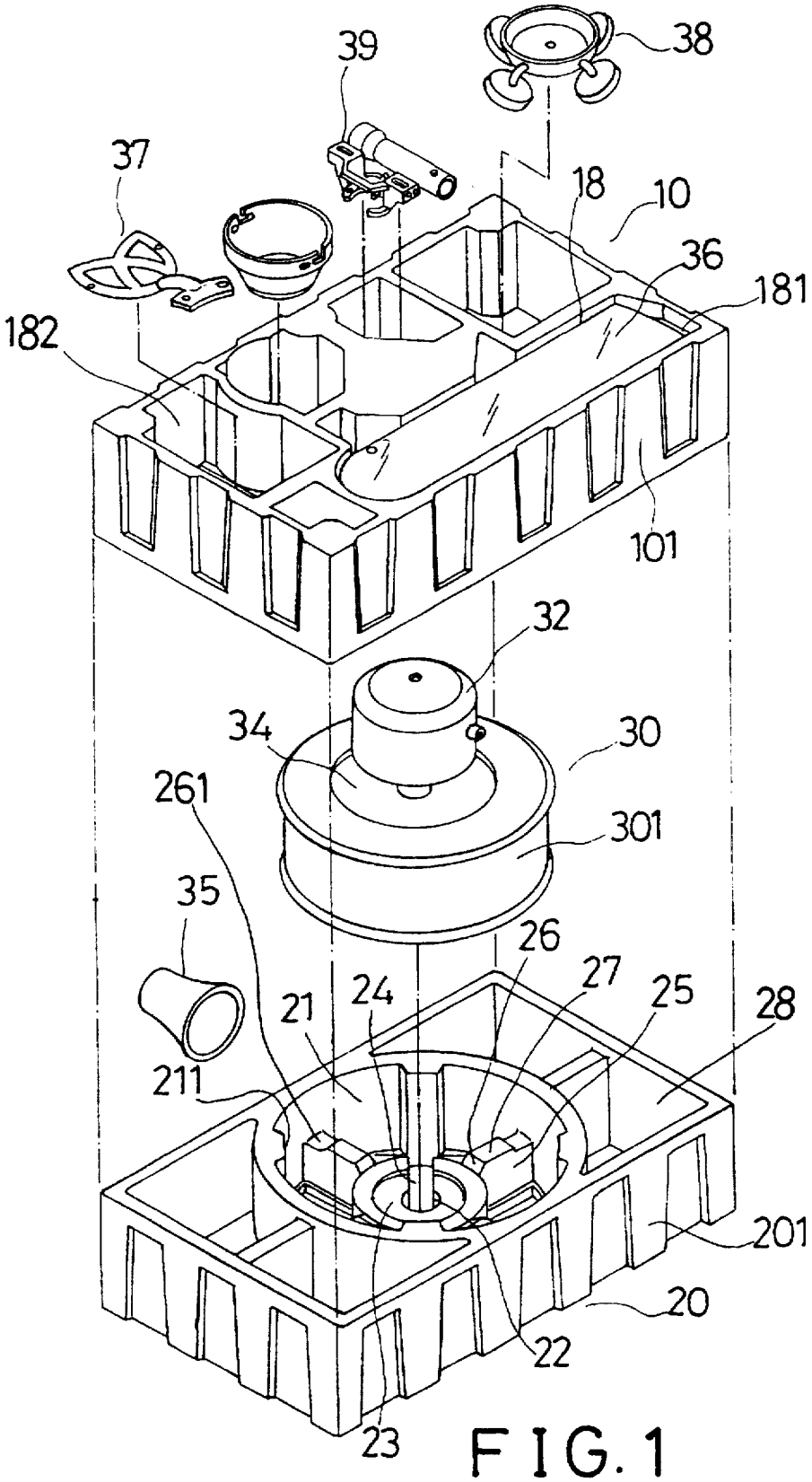
FIG. 1 is an exploded view of a ceiling fan package in ac dance with the present invention.
Figure 2:
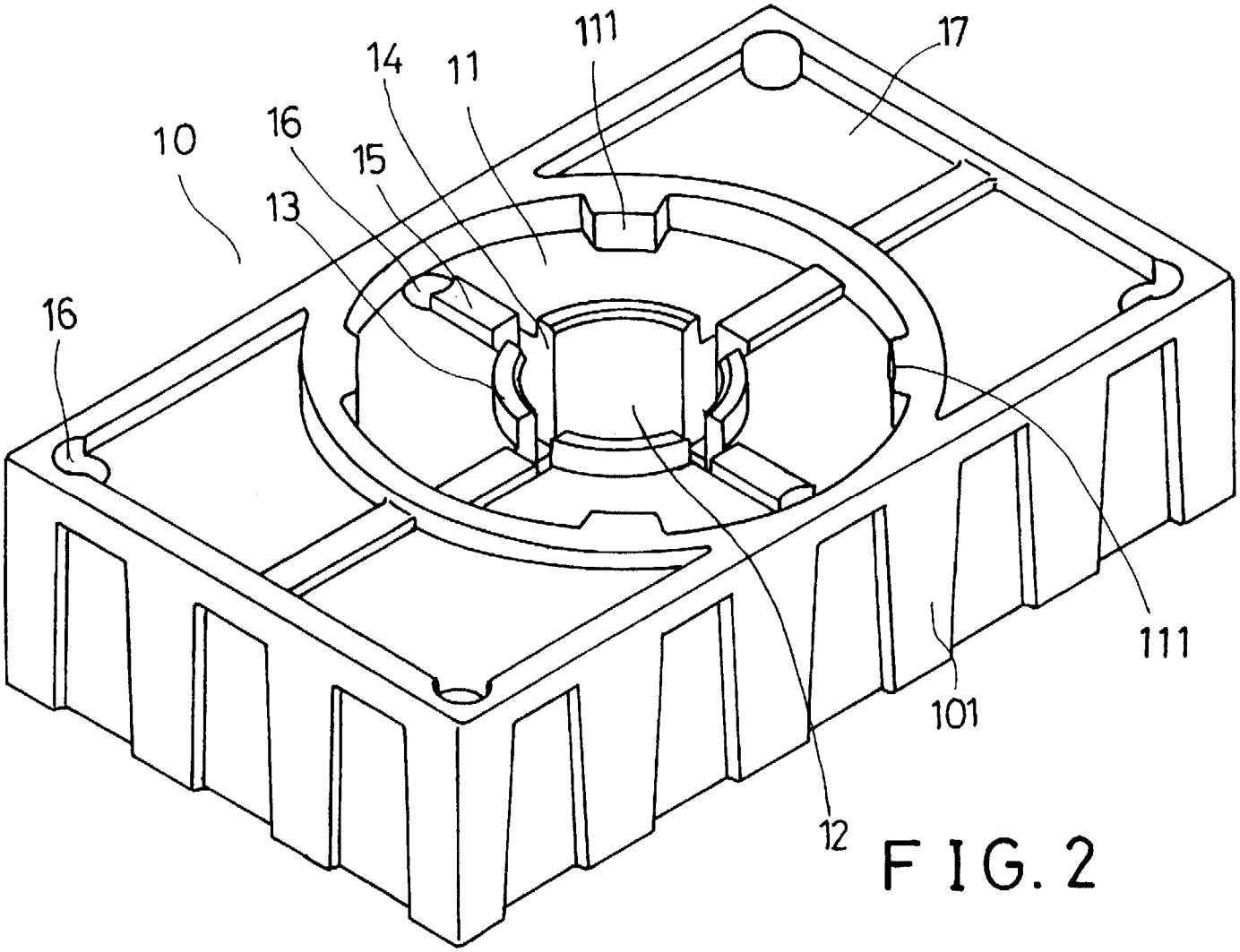
FIG. 2 is a bottom perspective view of the upper casing.
Figure 3:
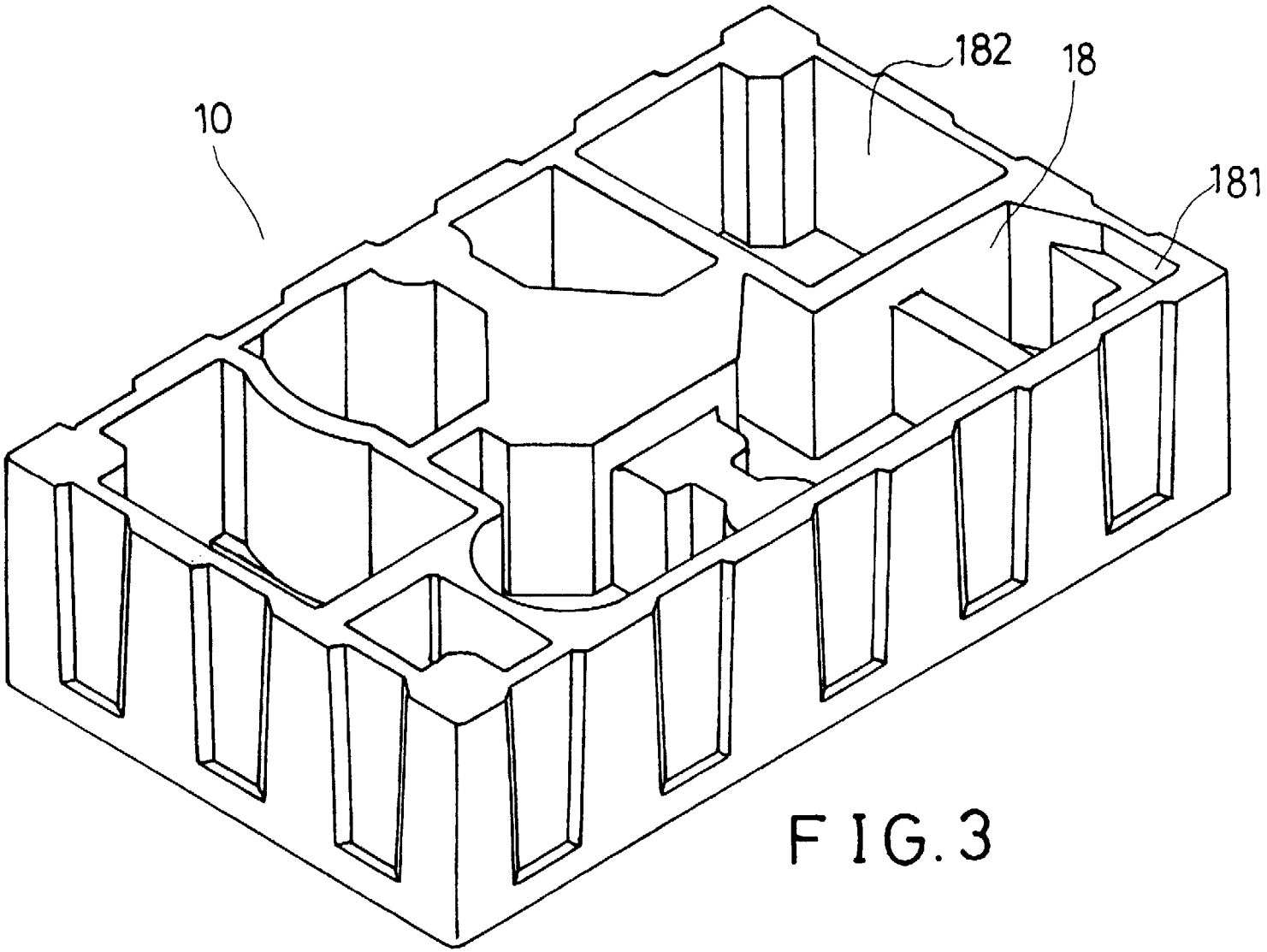
FIG. 3 is an upper perspective view of the upper casing.
Figure 4:
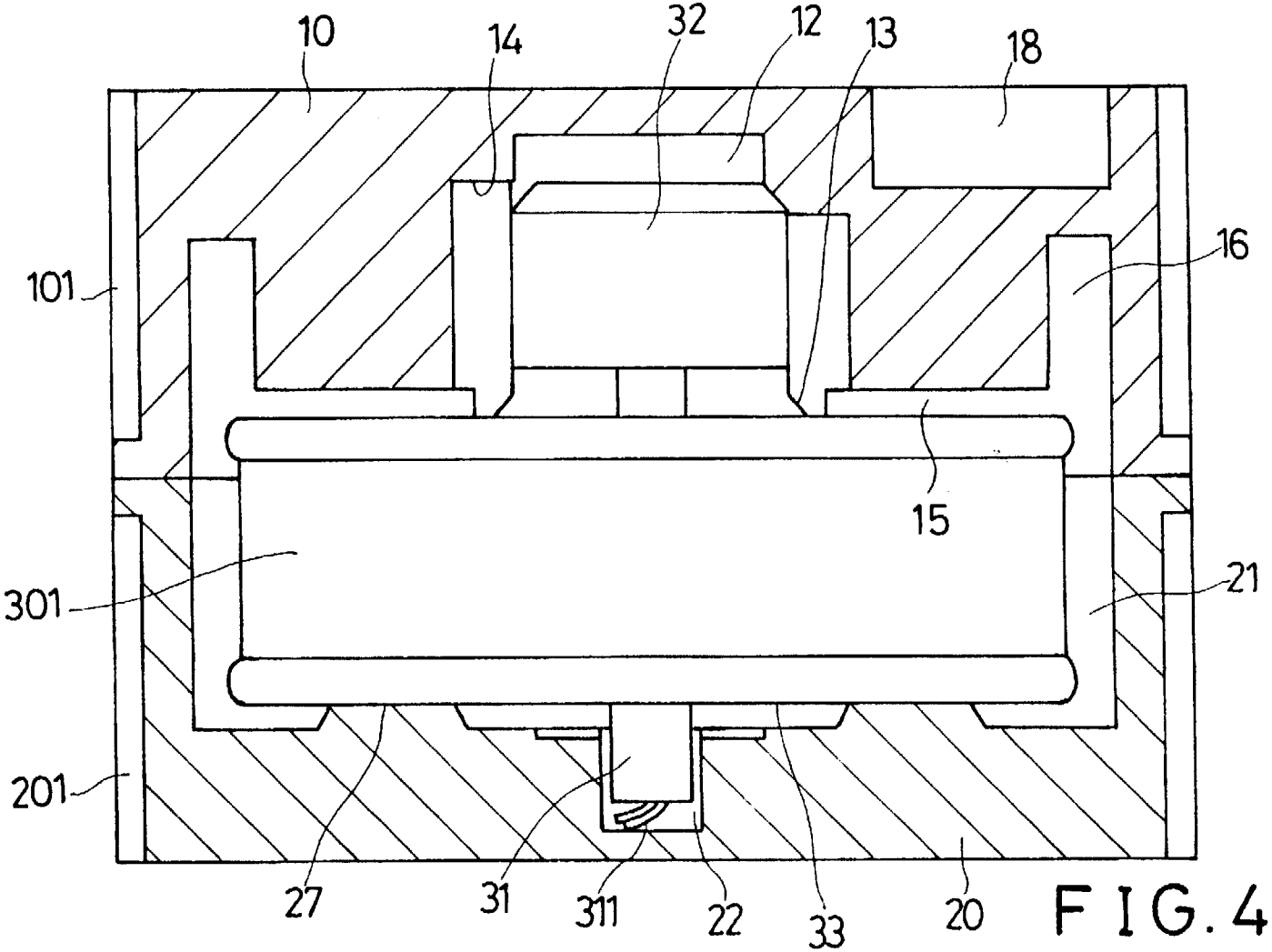
FIG. 4 is a cross sectional view of the ceiling fan package.

Referring to the drawings, and initially to FIGS. 1 and 4, a ceiling fan package in accordance with the present invention comprises a lower casing 20 including an opening 21 for engaging with the upper portion of the ceiling fan housing 30 and including a bore 22 for engaging with a shaft 31 (FIG. 4) which may be used for attaching the ceiling fan to the ceiling. The ceiling fan is disposed up side down. A depression 23 is formed in the center portion of the lower casing 20. Three or more bars 25 are radially extended in the opening 21 and each includes a tapered surface 26 facing toward the depression 23 and each includes a depression 261 distal to the tapered surface 26 so as to form a bulge 27 in the upper middle portion for engaging with the upper surface 33 (FIG. 4) of the ceiling fan housing 30. Accordingly, only the three or more bulges 27 are engaged with the upper surface of the ceiling fan housing 30. The lower casing 20 includes three or more ribs 211 extended radially inward of the opening 21 for engaging with the outer peripheral surface 301 of the ceiling fan housing 30. A groove 24 is formed in the lower casing 20 and communicating with the bore 22 for engaging with the electric wires 311 (FIG. 4) which are engaged in the shaft 31 of the ceiling fan. The groove 24 also forms a shock absorbing configuration. The lower casing 20 includes a number of cavities 28 for receiving lamp shades 35 and includes a number of swellings 201 formed in the outer peripheral surface for reinforcing purposes and for forming a shock absorbing configuration. The gaps formed between the swellings 201 may increase the resilience and the shock absorbing effect of the lower casing 20.

The upper casing 10 includes a number of swellings 101 formed in the outer peripheral surface for reinforcing purposes and for forming a shock absorbing configuration. The upper casing 10 includes a recess 18 for receiving the fan blades 36 and includes a notch 181 communicating with the recess 18 for preventing the end portion of the fan blades 36 from directly engaging with the upper casing 10 and for forming a shock absorbing configuration for the fan blades 36. The upper casing 10 includes a number of orifices 182 for receiving blade supports 37, bracket 39 and lamp holder 38. The ceiling fan includes a motor 34 engaged in the housing 30 and a control box 32 secured to the motor 34. The upper casing 10 includes an opening 11 for engaging with the lower portion of the ceiling fan housing 30 and includes a space 12 defined by a cylindrical wall 13 for stably receiving the control box 32, and includes a number of cavities 17 for engaging with the lamp shades 35. One or more slits 14 are formed in the cylindrical wall 13 for forming a shock absorbing configuration. The cylindrical wall 13 may engage with the motor 34 for stably securing the motor 34 in place. Three or more lumps 15 are formed in the upper casing 10 for engaging with the lower surface of the ceiling fan housing 30 and three or more ribs 111 are extended radially inward of the opening 11 for engaging with the outer peripheral surface 301 of the ceiling fan housing 30. The upper casing 10 includes one or more punctures 16 for forming shock absorbing configuration.

In operation, as shown in FIG. 4, the bulges 27 are engaged with the upper surface of the housing 30 and the lumps 15 are engaged with the lower surface of the housing 30, the ribs 211, 111 are engaged with the outer peripheral surface 301 of the housing 30, the cylindrical wall 13 is engaged with the motor 34 and the control box 32 is suitably engaged and received in the space 12 such that the ceiling fan can be stably retained in place. In addition, the groove 24, the punctures 16 and the slits 14 form an excellent shock absorbing configuration for the ceiling fan.

Accordingly, the ceiling fan package in accordance with the present invention may stably retain the ceiling fan in place and which may absorb shocks that may be transmitted to the ceiling fan.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A package for receiving a ceiling fan having a housing and a motor disposed in the housing and a control box coupled to the motor, the housing including an upper surface and a lower surface and a peripheral surface and a shaft extended from the upper surface, said package comprising:

a lower casing including a bore for receiving the shaft, and including a first opening for engaging with the housing, and including at least three bars for engaging with the upper surface of the housing, and including at least three first ribs radially extended inward of said first opening for engaging with the outer peripheral surface of the housing, and an upper casing including a second opening for engaging with the housing, and including a space for engaging with the control box, and including at least three lumps for engaging with the lower surface of the housing and for stably retaining the housing in said package.

2. A package according to claim 1, wherein said upper casing further includes a cylindrical wall for defining said space and for engaging with the motor and for stably retaining the motor in place.

3. A package according to claim 2, wherein said cylindrical wall includes at least one slit for forming a shock absorbing configuration.

4. A package according to claim 1, wherein said upper casing includes at least three second ribs radially extended inward of said second opening for engaging with the outer peripheral surface of the housing.

5. A package according to claim 1, wherein said upper casing includes at least one puncture for forming a shock absorbing configuration.

6. A package according to claim 1, wherein said upper casing and said lower casing each includes an outer peripheral surface having a plurality of swellings for forming a shock absorbing configuration.

* * * * *